US006902166B2

(12) United States Patent
Stern

(10) Patent No.: US 6,902,166 B2
(45) Date of Patent: Jun. 7, 2005

(54) METHOD OF PLAYING A CARD GAME

(76) Inventor: Max Stern, 6351 Chisos Dr., Las Vegas, NV (US) 89103

( * ) Notice: Subject to any disclaimer, the term of this patent is extended or adjusted under 35 U.S.C. 154(b) by 0 days.

(21) Appl. No.: 10/456,130

(22) Filed: Jun. 7, 2003

(65) Prior Publication Data

US 2004/0222592 A1 Nov. 11, 2004

Related U.S. Application Data

(60) Provisional application No. 60/468,201, filed on May 6, 2003.

(51) Int. Cl.[7] ..... A63F 1/00
(52) U.S. Cl. ..... 273/292; 463/12
(58) Field of Search ..... 273/292, 274, 273/309; 463/12, 13

(56) References Cited

U.S. PATENT DOCUMENTS 5,013,049 A * 5/1991 Tomaszewski ..... 273/292
5,364,105 A * 11/1994 Jones ..... 273/292
5,397,128 A * 3/1995 Hesse et al. ..... 273/292
5,628,514 A * 5/1997 Nguyen et al. ..... 273/292
5,713,574 A * 2/1998 Hughes ..... 273/292
5,725,215 A * 3/1998 Hesse ..... 273/292

OTHER PUBLICATIONS

Scarne's Encyclopedia of Games. "Banking Card Game: Blackjack or Twenty One", and "Fifteen", Harper & Row Publishers, pp. 276–288, 1973.*
"Super Blackjack", Casino Gaming Concepts, 1993.*
"Bacc–Jack", Casino Gaming Concepts, 1995.*

* cited by examiner

*Primary Examiner*—Benjamin Layno
(74) *Attorney, Agent, or Firm*—Jeffrey C. Maynard

(57) ABSTRACT

Concepts for playing a card game using a plurality of modified decks of cards. Each deck containing only the Ace to the 8. The player wagers against a banker to try to get as close to a designated point total of 15 without exceeding it. The player can hit or stand on any point total. A winning player is paid based upon a first variable wager. After comparing the player's hand to the banker's hand, the player's hand is compared to a Bonus Pay Table. If the player's hand contains a designated combination, the player is paid based upon a second fixed wager. The game also offers the opportunity to buy odds concerning the occurrence of a selected outcome. The game can be played as a table game on as an electronic video game.

3 Claims, 4 Drawing Sheets

METHOD OF PLAYING A CARD GAME

CROSS REFERENCE TO RELATED APPLICATION

This Application claims the benefit of U.S. Provisional Application, Ser. No. 60/468,201 entitled Method of Playing a Card Game, filed with the U.S. Patent and Trademark Office on May 6, 2003 by the inventor herein.

BACKGROUND OF THE INVENTION

1. Field of the Invention

This invention relates generally to games of chance such as would be found in casinos and other legal gambling establishments and more particularly to electronic gaming systems that can be used as slot machines. The game is enabled, in particular, for video gambling machines, computer games, or other electronic or mechanical devices, however the game can also be played as a table game.

2. Background of the Prior Art

In the gaming business there are generally two kinds of games; one in which the results depend solely on luck, and another in which the results depend on the skill of the players. Examples of games depending solely on luck include basic slot machines, roulette, and craps. Examples of games depending on the players' skill include draw poker and blackjack.

Blackjack is a staple of most casinos. Conventional Blackjack involves a game of chance between a dealer and one or more players. The object is for the player to achieve a count of his hand closer to 21 than the count of the hand of the dealer; but if the count of the player's hand goes over 21 then the player loses regardless of the final count of the dealer's hand.

The conventional manner of play of Blackjack is as follows: A standard deck of playing cards is used and each card counts its face value, except Aces, which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try to beat the count of the dealer's hand. If the player's count exceeds 21, the player "busts." The player may "stand" on any count of 21 or less. When a player busts, he loses his wager regardless of whether or not the dealer busts.

After all of the players have taken hits or have stood on their hand, the dealer "stands" or "hits" based on preestablished rules for the game. Typically, if the dealer has less than 17, the dealer must take a hit. If the dealer has 17 or more, the dealer stands.

As the game of Blackjack is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 1, instead of as a count of 11. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to a numerical count of 21, without going over, wins; tie hands are a "push."

Many variations to the conventional Blackjack game have been developed to increase the enjoyment of play by adding various wagering options. Applicant knows of no game that uses a modified deck of cards and provides several opportunities to win, such as by achieving a winning point total, by achieving a predetermined sequence of cards, and by "buying odds" for particular card sequences.

A need exists for a wagering game that is intended to be played in gambling casinos, that is simple to learn and fun to play. There is a need for new games that are capable of encouraging a high volume of play while at the same time offering what the players consider to be good pay tables. There is a need for new games that can be played as a table game and as an electronic video game. Furthermore, there is a need to provide new and interesting electronic video games that attract players and that can increase the volume of wagering in each gaming machine.

SUMMARY OF THE INVENTION

The present invention fulfills these needs. It is a fast-paced game of simple consistent rules, player participation, and choice of risk offered by a variety of games and corresponding to varying payout. The house edge is fairly derived and players will detect this fairness through the payout odds. These features will increase the number of players to the game, both experienced and inexperienced players, generating player satisfaction and profitability to the casino.

Primary objects are to provide: (a) game concepts, (b) method steps for play of a round, and (c) software programming concepts for apparatus enabling a slot machine game.

Another object of the present invention is straightforward entertainment with some of the atmosphere of a casino. A related object of the present invention is to provide an enjoyable gambling game.

It is a further object of the present invention to provide a game that will be easy for players to learn.

A further object is implementation of supervision and control of the flow of a slot machine game by a computer software program.

Another object is to provide visible winning results promptly for entertainment purposes, or, additionally, for wagering such that a casino atmosphere of chance is available for a single, or for a plurality of players, in a single round. A related object is to provide such winning results in a slot machine game.

It is a still further object of the invention to provide a new wagering game that encourages a high amount of individual player interest while maintaining acceptable payback percentages. A related object is to provide a video gaming machine apparatus, which displays a new and interesting game.

A further object of the present invention is to enable adaptation of the invention to usage independent of a gaming establishment, including individual personal usage.

The above and other objects, features, and advantages of the present invention are described in more detail with reference to the accompanying drawings.

According to a first aspect, the game can be played as a table game with one or several modified decks of cards containing only the Ace to the 8 in the four suits of any regular deck of cards. At the beginning of the game the players post two bets; one for the final result of the hand (variable) and another one (fixed), wagering that the player is going to hit one hand from a bonus pay table. The players and the banker are dealt two cards. With this two cards the player, according to his knowledge and skill will "hit" as many cards as necessary in order to get the closest possible to 15 points and not to "bust." The player may "stand" at any point.

After the players complete their cycle, the banker plays its hand according to prescribed rules. The bank must "hit" until 12 points is reached, and must stand once that total is reached. The player or banker who ends up the throw closest to 15 points will become the winner of the variable wager. Next the players' final hand is evaluated. If the first three cards match a winning combination from the bonus pay table, the player wins an additional payout, based upon the second wager.

During play of the game, if the player has received two cards for a particular predetermined sequence, the player may make an additional wager on the outcome of the next card. For example, if the player has two of a kind, the player may make an additional wager that the player will obtain three of a kind. The winning payout will depend upon the attempted hand and the probability that the hand can be achieved.

A second aspect of the present invention provides a video gaming machine including display means arranged to display a game being played on the machine, game initiating means to initiate a game on the machine, and game control means responsive to the initiating means to control the playing of the game, characterized in that the game enables a player to play a game based on a combination of luck and skill, the display means is arranged to display a plurality of indicia, each indicia being associated with random elements according to a selected game, the control means is characterized by evaluating such indicia based on predetermined winning combinations, enabling additional wagers based on predetermined combinations, and awarding a prize to the player, in the event indicia of such elements and such additional elements creates a winning combination and/or exceeds the banker's total.

In a preferred embodiment, the display means is a touch sensitive video screen and the player selects game options by touching areas of the screen on which prompts are displayed; however, other selection mechanisms are also possible, such as buttons indicating grid references on the display.

Whether solely for amusement or for entertainment with wagering, an electronic video game machine can be used. Such sets of indicia can be displayed in an electronic or other machine play apparatus.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following detailed description, which should be read in conjunction with the accompanying drawings in which like reference numbers are used for like parts. This detailed description of an embodiment, set out below to enable one to build and use an implementation of the invention, is not intended to limit the enumerated claims, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

In the following detailed description, the methodology of the embodiments will be described and it is to be understood that it is within the capabilities of a non-inventive worker in the art to introduce the methodology on any standard microprocessor based gaming machine by means of appropriate programming.

Figure 1:
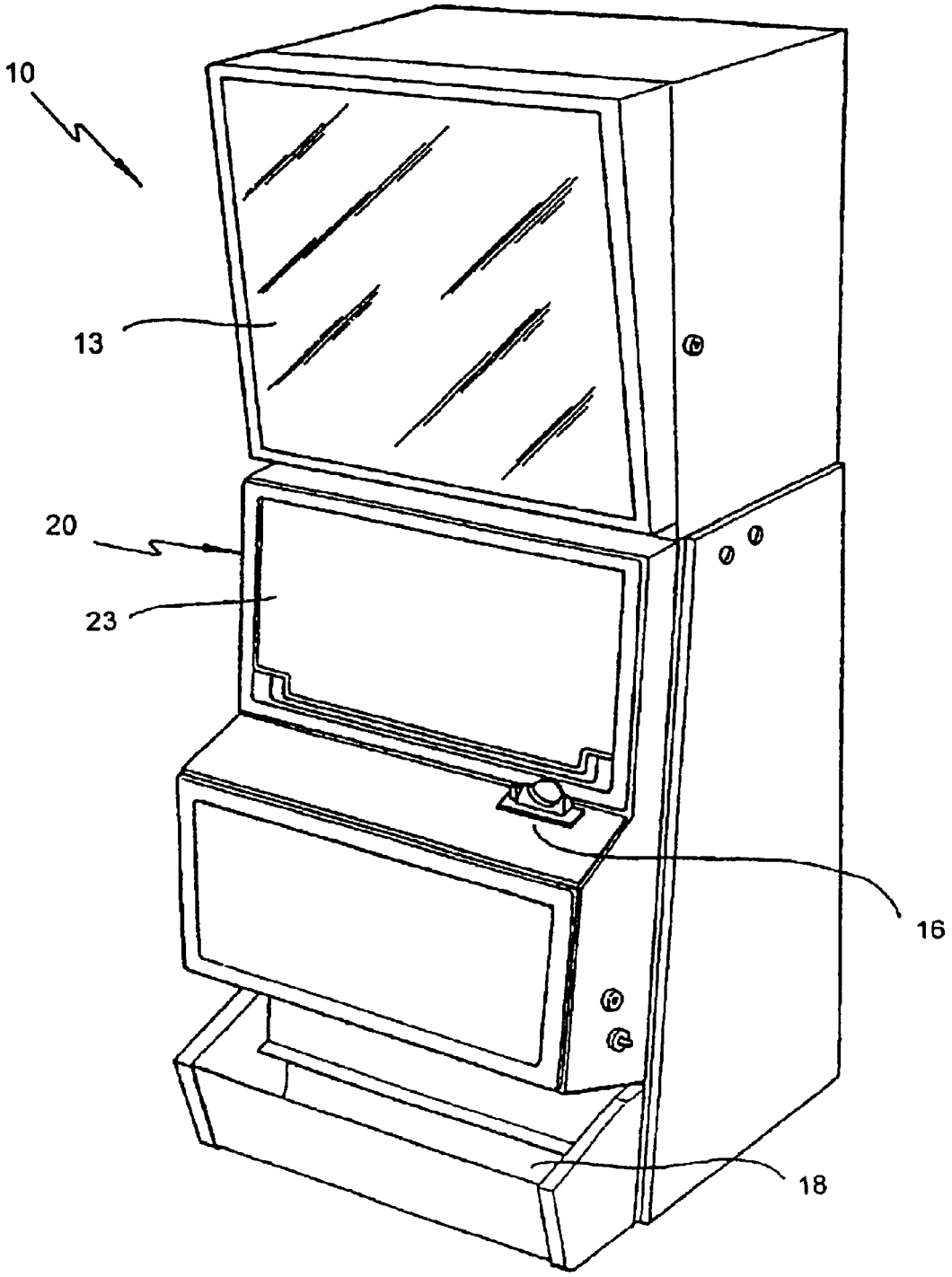
FIG. 1 is an illustration of a slot machine incorporating the present invention.

In FIG. 1, the illustrated embodiment of the invention is housed in a slot machine cabinet 10 including a decorative panel 13 for displaying advertising, a trademark, a decorative picture, a brief description of game instructions, and the like. A coin entry slot 16 is provided to receive coins, tokens or game chips (hereinafter coins) for wagering on a play of the game. A payout tray or coin hopper 18 is disposed on the front of cabinet 10 for holding coins dispensed in the course of a game.

Preferably, a game display means comprises a video display screen 20 controlled to display indicia images as described later herein. The video screen is preferably of the touch sensitive variety, having a touch sensitive input area 23 located on its display surface on which player selections for play of the game described herein are to be made.

Figure 2:
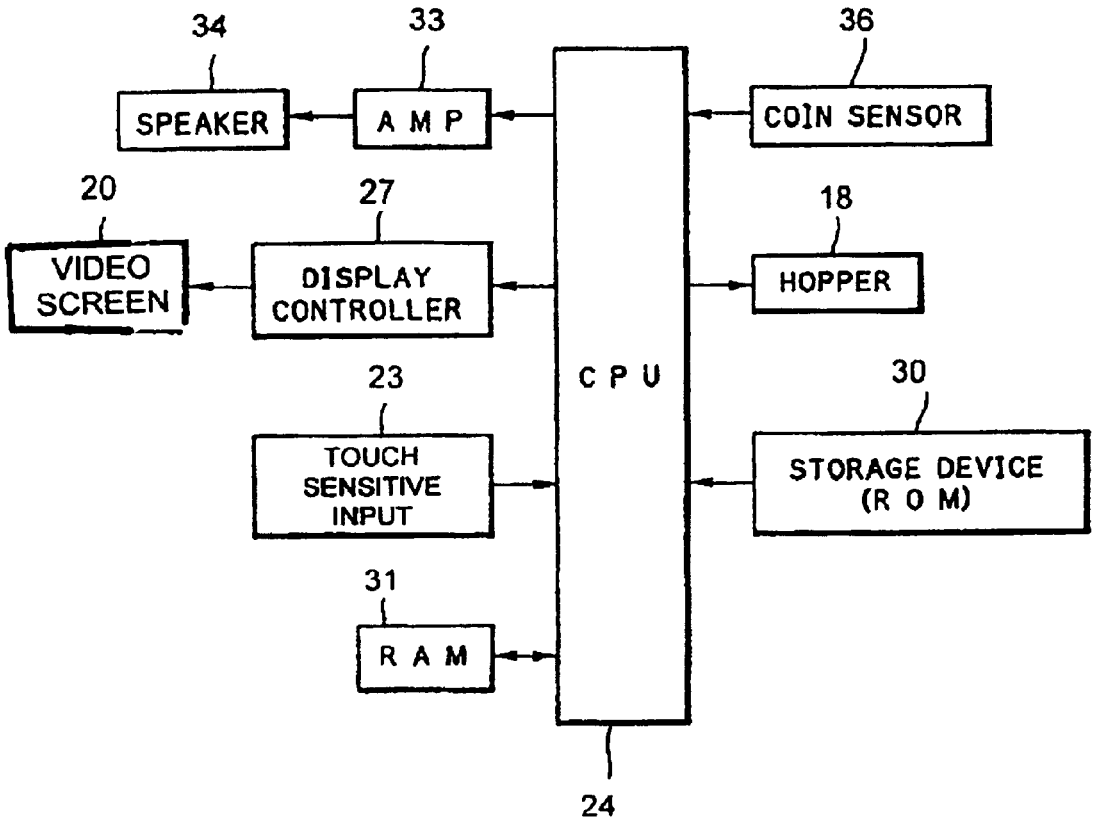
FIG. 2 is a block diagram illustration of processing components for performing functions according to the present invention.

FIG. 2 shows a block diagram illustration of processing components for performing functions according to the present invention. A central processing unit (CPU) 24 is connected to touch sensitive input area 23 for receiving player input. The central processing unit 24 receives player input and controls the play of the game. CPU 24 also controls the display of images (characters, numbers, and symbols) on video screen 20 to operate each unit. A display controller 27 controls the display of images to video screen 20.

A storage device 30 is constituted of a ROM, a hard disk, or the like, and stores a program for playing a slot machine game, symbol patterns of each playing element, and the like. RAM 31 is used for storing data input from the touch sensitive input 23, such as a score list indicating the contents of played games, the number of credited coins, and the like.

In an alternate embodiment, an amplifier 33 drives speaker 34 for generating sounds to resemble shuffling cards, to highlight game result conditions, game termination, and the like.

A coin sensor 36 detects a coin inserted into the coin entry slot 16. The hopper 18 ejects credited coins.

Figure 3:
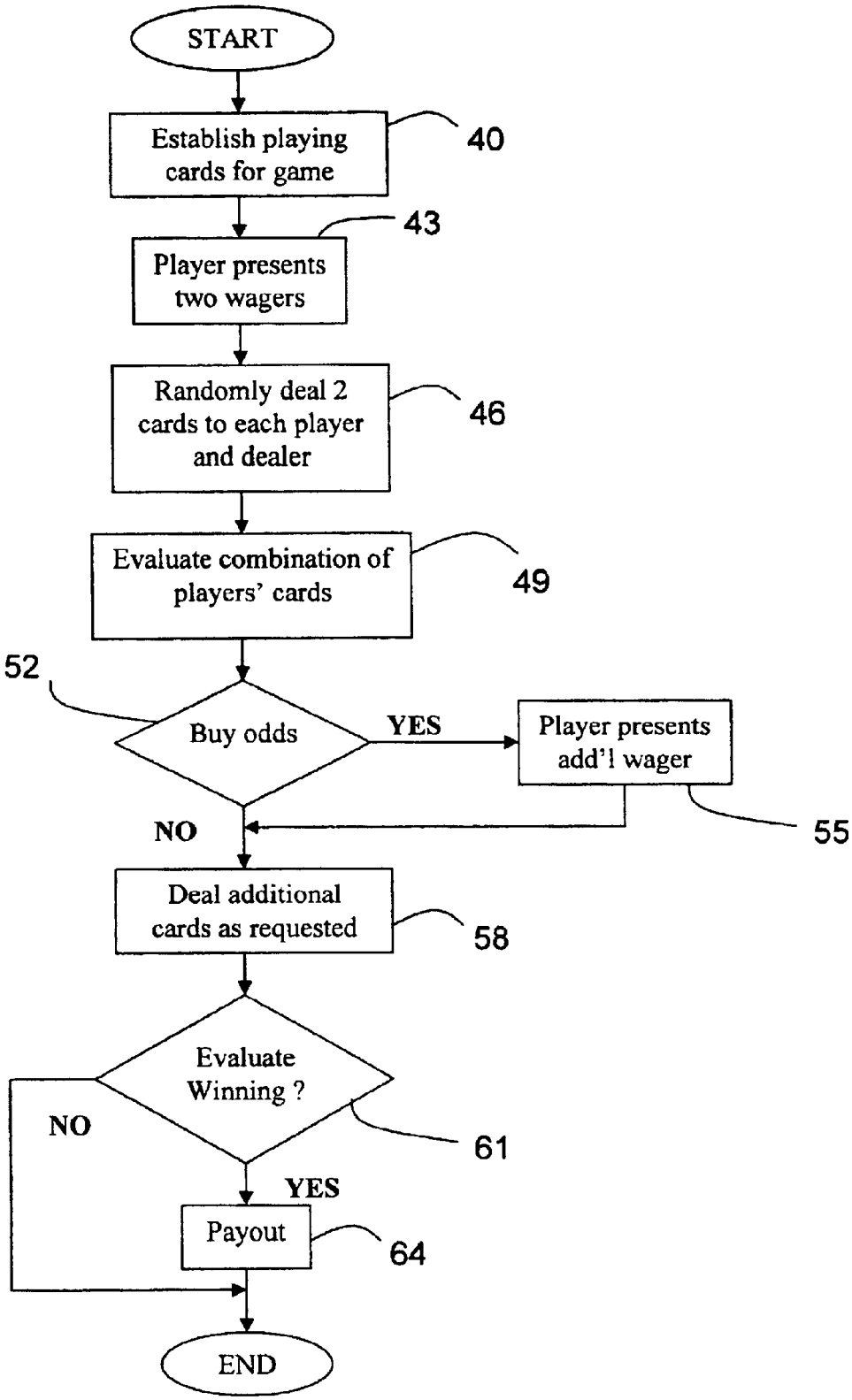
FIG. 3 show a flowchart illustrating various steps of one embodiment of the present invention.

Referring to FIG. 3, the steps of the method for play of the game is illustrated. In a first embodiment, during the first step, indicated at 40, a standard deck of cards is modified to contain only the Ace through 8 of the four standard suits, for a 32-card deck. Various numbers of such modified decks of cards can be brought into play. In a preferred embodiment, four such decks are employed. Alternate embodiments can be used having modified decks containing the Ace through 6 or the Ace through 7 of the four standard suits. In such embodiments, the object is to achieve a score of 15 by counting the face-value number of the cards dealt. An Ace can count for one or eleven. In an alternate embodiment, the object is to achieve a score of 16 by counting the face-value number of the cards dealt. In a further alternate embodiment, the Ace will count for one, only.

The next step, indicated at 43, a player presents two wagers, which can include an administrative fee for management of the game, as well as the "ante" to participate. The first wager may be a variable amount and dependent upon the final score of a round. A minimum and maximum for competitive wagering can be prescribed for an individual round. The second wager is a fixed amount and dependent upon the combination of cards for a round. Present concepts can provide for handling differing wagering amounts for one or more players.

The next step, at 46, two cards are displayed (as if dealt face up) from the established modified deck of cards for each player and two cards are displayed for the banker, only one of which is face up.

At 49, the players' hand is evaluated to determine if it is eligible to buy odds. Eligible hands are shown in Table 1. At 52, the player determines if he or she would like to "buy odds" that a particular hand will be achieved based on the two cards already showing. For example, if the player is dealt two 5s of Spades, the player can present an additional wager, at 55, that such player will achieve a final hand with three 5s of Spades. For such additional wager, only the first three cards dealt are counted.

TABLE 1

| Dealt Hand | Attempted Hand | Odds |
|---|---|---|
| Two 5s of Spades | Three 5s of Spades | 64:1 |
| Two 5s of same suit | Three 5s of same suit | 64:1 |
| Two of a kind, same suit | Three of a kind, same suit | 64:1 |
| Two 5s of different suits | Three 5s | 9:1 |
| Two of a kind, different suits | Three of a kind | 6:1 |
| Two card straight flush | Three card straight flush | 15:1 |
| Two card mini royal | Three card mini royal | 30:1 |
| Two card straight | Three card straight | 4:1 |
| Ace-Two | Ace-Two-Three | 8:1 |
| Two card score of 15, same suit | | 32:1 |
| Two card score of 15, different suits | | 8:1 |

In some embodiments, a player can "buy odds" before the first cards are dealt. In such a case, the player is wagering that the first two cards will equal a score of 15, either of the same suit or of different suits. The odds for such wager are listed in Table 1.

Play of the game continues as shown at 58. A player may draw additional cards (take "hits") in order to try to beat the count of the banker hand. If the player's count exceeds 15, the player "busts." The player may "stand" on any count of 15 or less. When a player busts, he loses his first wager regardless of whether or not the banker busts.

After all of the players have taken hits or have stood on their hand, the banker "stands" or "hits" based on preestablished rules for the game. If the banker has less than 12, the banker must take a "hit." If the banker has 12 or more, the banker stands. If the banker is showing two Aces, it will always be considered as 2 points, and the banker must take a "hit."

The next step, at 61, the winning events are determined and a payout is made, at 64, to players' with winning hands. A player with a score greater than the banker, if such player did not bust, is a winner. A player with a score less than 15, if the banker busts, is a winner. After the winning score is paid, based on the first wager, the players' hand is compared to the Bonus Pay Table, such as shown in Table 2. Each winning combination is paid according to the rank for each such winning hand, if any, based on the second wager.

TABLE 2

| BONUS PAY TABLE | |
|---|---|
| Three 5s of Spades | 40,000 |
| Three 5s of the same suit | 4,000 |
| Any 3 of a kind of the same suit | 250 |
| 4-5-6, same suit | 200 |
| 4-5-6, different suits | 10 |
| Any 3 of a kind, different suits | 5 |

In addition, any player that presented an additional wager to "buy odds," at 55, is paid if the hand achieved the designated combination.

A goal of the game is to achieve a score greater than the banker's score without exceeding 15. Players can also succeed by obtaining a hand that contains a winning combination of elements according to defined combination rankings. If a player's hand contains a winning combination, the player receives payment on his or her second wager. If a player's hand does not contain a winning combination, that player loses his or her second wager.

The steps and functions of a controller are established on software and take place electronically in video games to provide and distribute electronic designation of playing cards, to maintain control of play of the game for plural players, and to sequence the steps of the game properly, while providing for selections made by a player, or players. Such game controller is also responsible for collecting wagers that are lost and making payments to winners, according to the applicable game.

While the preferred embodiment uses four modified decks containing the Ace through 8 of four standard suits, an alternate embodiment of the game can be played using a modified deck of cards containing the Ace through 9 of four standard suits. In such alternate embodiment, a player attempts to achieve a total score of 18. Eligible hands to "buy odds," at station 49 are shown in Table 3.

TABLE 3

| Dealt Hand | Attempted Hand | Odds |
|---|---|---|
| Two 6s of Spades | Three 6s of Spades | 70:1 |
| Two 6s of same suit | Three 6s of same suit | 70:1 |
| Two of a kind, same suit | Three of a kind, same suit | 70:1 |
| Two 6s of different suits | Three 6s | 10:1 |
| Two of a kind, different suits | Three of a kind | 10:1 |
| Two card straight flush | Three card straight flush | 15:1 |
| Two card mini royal | Three card mini royal | 35:1 |
| Two card straight | Three card straight | 4:1 |
| Ace-Two | Ace-Two-Three | 8:1 |
| Two card score of 18, same suit | | 35:1 |
| Two card score of 18, different suits | | 8:1 |

The Bonus Pay Table for such alternate embodiment is shown in Table 4.

TABLE 4

| BONUS PAY TABLE | |
|---|---|
| Three 6s of Spades | 60,000 |
| Three 6s of the same suit | 5,000 |
| Three 6s | 150 |
| Any 3 of a kind of the same suit | 200 |
| 5-6-7, same suit | 160 |
| 5-6-7, different suits | 10 |
| Any 3 of a kind, different suits | 10 |

Embodiments of the game taught herein vary significantly from conventional Blackjack. Until now, no card game used a modified deck of cards and provided such plurality of opportunities to win, such as by achieving a predetermined point total and by achieving a predetermined sequence of cards. No card game enabled a player to "buy odds" to try to achieve a winning combination.

Among the advantages of the invention are the simplicity of play and ease of administration. Novel concepts of this invention provide for games that are easy to administer and fun to play.

The game can be played as a table game, but is preferably played in video poker machines, computers, video game machines, and hand-held, mechanical, or video poker devices. A video machine can enable a single player to play more than one hand at a time and can be used to accommodate a plurality of players.

As can be seen from the description of the embodiments, the present invention is readily adaptable to play on a computer or video game. A person skilled in the art of computer and video game construction, as well as those skilled in other arts, will incorporate the method and conduct of this invention in such computer and video games.

Figure 4:
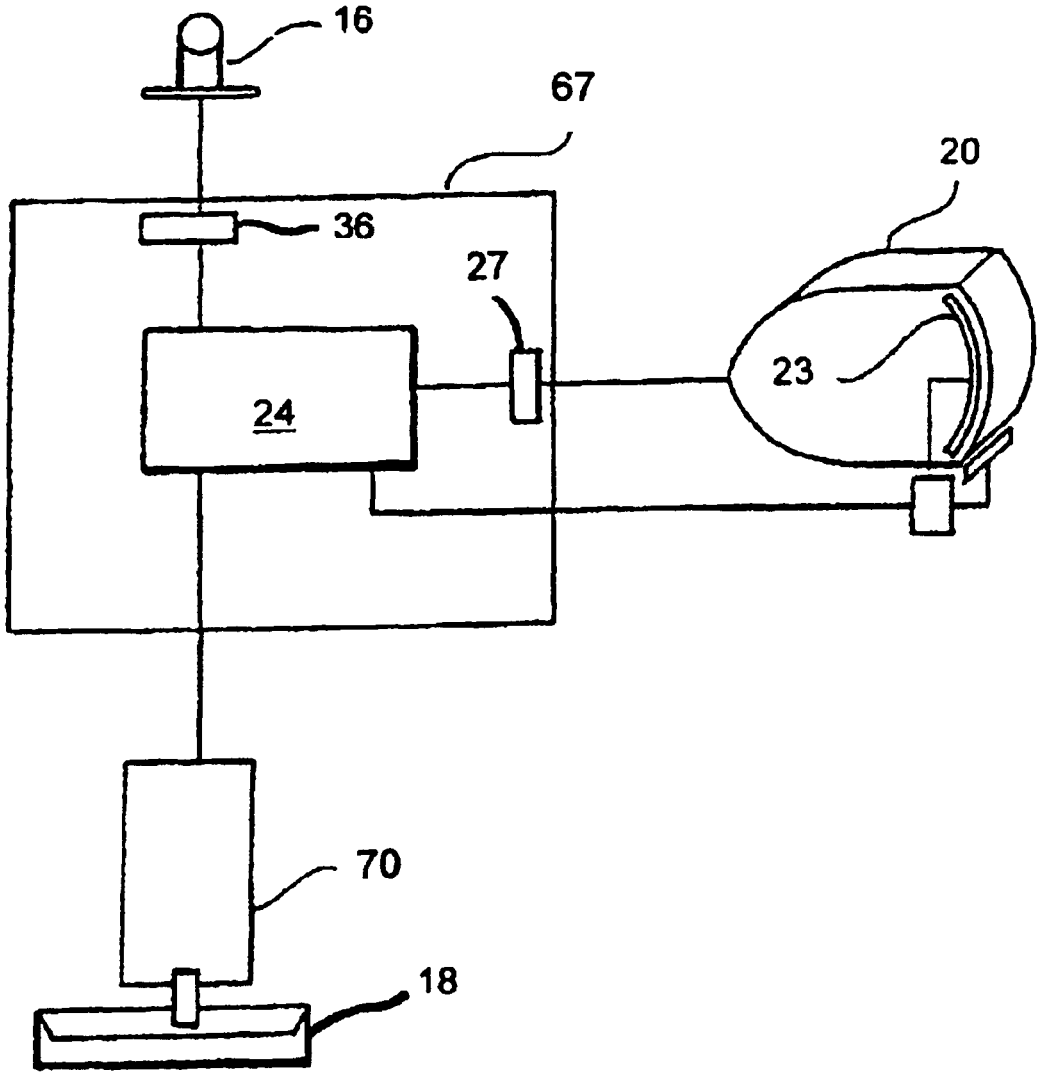
FIG. 4 is a schematic diagram of a slot machine control circuit according to the present invention.

A program to implement the sequence of the game can execute on a standard gaming machine as illustrated schematically in FIG. 4. CPU 24 forms part of slot machine controller 67 that drives the video screen display 20 and receives touch input signals from touch sensors 23 as well as receiving coin input pulses from coin sensor 36 and driving a coin payout mechanism 70.

In a preferred embodiment, a plurality of slot machine devices, as taught herein, can be connected to a central controller, which can be used to maintain a jackpot prize schedule for all devices in a network of devices. In this manner, several gaming establishments can combine to offer a single prize larger than any one establishment. Alternatively, each slot machine device can be adapted for maintaining a jackpot prize schedule for independent operation.

The invention has been described with references to a preferred embodiment and several alternate embodiments. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art could modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A method of playing a card game, comprising the steps of:

a) establishing at least one deck of cards having four suits and no more than the Ace, two, three, four, five, six, seven, and eight of each suit;

b) a player making a first ante to be eligible to participate, such first ante comprising:
i) a variable wager; and
ii) a fixed wager;

c) dealing two cards to the player and at least one card to a banker, one card of the banker's hand being dealt face-up;
i) evaluating the player's two cards to determine eligibility to buy odds for the ocurrence of subsequent car; and
ii) the player making a second ante buy odds for the ocurrence of a specific subsequent card;

d) the player standing or receiving additional cards from the banker as the player desires to achieve a point total as close as possible to 15, without exceeding 15, defining the player's hand e) the banker standing or receiving additional cards as part of his hand to achieve a point total greater than or equal to 12, without exceeding 15;

f) the banker comparing his hand to the player's hand;

g) the banker paying the player based on the amount of the player's variable wager if the player's hand beats the banker's hand or collecting the player's first ante if the banker's hand beats the player's hand;

h) the banker comparing the player's hand to a bonus pay table; and i) the banker paying the player based on the amount of the player's fixed wager if the player's hand matches one of the hands in the bonus pay table.

2. The method of claim 1, further comprising, after step d), the steps of:

d1) the banker comparing the player's first three cards to a predetermined buy odds table;

d2) the banker paying the player based on the amount of the player's second ante if the player's hand matches one of the hands in the predetermined buy odds table.

3. The method of claim 1, wherein four decks of cards having four suits each and only the Ace, two, three, four, five, six, seven, and eight of each suit are used.

* * * * *